US005372285A

United States Patent [19]

Harrold et al.

[11] Patent Number: 5,372,285

[45] Date of Patent: * Dec. 13, 1994

[54] VERTICAL RATCHET GEL-LIKE MATERIAL DISPENSER WITH HINGED TRIGGER

[75] Inventors: John E. Harrold, Borough of Bloomsbury; Jack Weinstein, Manchester Township, Ocean County, both of N.J.

[73] Assignee: Primary Delivery Systems, Inc., Easton, Pa.

[ * ] Notice: The portion of the term of this patent subsequent to Jun. 14, 2011 has been disclaimed.

[21] Appl. No.: 169,008

[22] Filed: Dec. 20, 1993

Related U.S. Application Data

[63] Continuation-in-part of Ser. No. 56,866, May 5, 1993, Pat. No. 5,320,259, which is a continuation-in-part of Ser. No. 973,712, Nov. 9, 1992, abandoned.

[51] Int. Cl.[5] ..... B67D 5/42

[52] U.S. Cl. ..... 222/189; 222/391; 401/181

[58] Field of Search ..... 401/66, 179, 181; 604/209, 210, 224; 132/318; 206/385; 222/189, 326, 327, 391

[56] References Cited

U.S. PATENT DOCUMENTS

| | | | |
|---|---|---|---|
| 1,467,282 | 9/1923 | Bergen | 401/66 |
| 2,086,462 | 7/1937 | Bost | 604/224 |
| 2,528,839 | 11/1950 | Mason | 401/66 |
| 2,718,299 | 9/1955 | Atwater et al. | 401/66 X |
| 2,872,034 | 2/1959 | Harris | 132/318 |
| 3,221,409 | 12/1965 | Thiel et al. | 222/391 |
| 3,492,993 | 2/1970 | Tillmann | 604/224 X |
| 3,902,814 | 9/1975 | Cardia | 401/60 X |
| 3,977,574 | 8/1976 | Thomas | 222/391 |
| 4,318,499 | 3/1982 | Hamilton | 222/391 X |
| 4,323,176 | 4/1982 | Sartain | 222/326 |
| 4,352,579 | 10/1982 | Yi | 401/66 X |
| 4,710,178 | 12/1987 | Leonard et al. | 401/181 X |
| 4,779,770 | 10/1988 | Herold | 222/391 |
| 5,004,124 | 4/1991 | Stefaniak | 222/391 X |

*Primary Examiner*—Andres Kashnikow
*Assistant Examiner*—Kenneth Bomberg
*Attorney, Agent, or Firm*—Kenneth P. Glynn; Gina M. Gualtieri

[57] ABSTRACT

The present invention involves a dispenser. The dispenser includes a main hollow housing with side walls, a base and an open top which contains a manifold component for dispensing material therethrough. At least one vertical support column is included within the hollow housing and it has horizontal ratchets thereon as well as a push plate located at its top. A trigger component is also contained within the housing and it is formed of plastic material with at least one flexible portion therein. It acts as a trigger, a ratcheting member and a spring, and is strategically positioned in a hinged manner such that a side wall cut-out or other member holding the trigger component against the vertical support column ratchets may be rotated inwardly and released outwardly to cause the ratcheting mechanism to advance the support column. Thus, the trigger component has a first position and a second position wherein, when it is moved from the first position to the second position, it advances the vertical support column upwardly and when it is released and moves from its second position back to its first position, it retreats to the next lower ratchet on the support column and is set for the next advance. In one preferred embodiment, the main hollow housing has two separate components for ease of manufacturing and assembling.

16 Claims, 3 Drawing Sheets

VERTICAL RATCHET GEL-LIKE MATERIAL DISPENSER WITH HINGED TRIGGER

REFERENCE TO RELATED APPLICATION

This application is a continuation-in-part of copending U.S. patent application Ser. No. 08/056,866, now U.S. Pat. No. 5,320,259, filed on May 5, 1993 by a common inventor herein, entitled "Vertical Ratchet Dispenser with Hinged Trigger", which is itself a continuation-in-part of copending U.S. patent application Ser. No. 07/973,712 (now abandoned), filed on Nov. 9, 1992, by a common inventor herein, entitled "Vertical Ratchet Dispenser".

BACKGROUND OF THE INVENTION

1. Field of the Invention

The present invention is directed to dispensers and, more specifically, to vertical ratchet dispensers which are utilized to advance viscous liquids, creams, pastes, and gels, and the like, to move dispensing material out of the dispenser at rates and times desired by the user. More specifically, the present invention is directed to such dispensers which involve vertical ratcheting by utilization of a unique ratcheting arrangement which functions in combination with a hinged trigger and dispenses through a manifold component.

2. Prior Art Statement

Numerous ratcheting dispensers have been developed over the years and date back more then half a century. They have been developed for many purposes and have diverse mechanisms for operation. Additionally, various types of tubes and dispensers have been developed to advance cakes and pastes and bar materials such as underarm deodorant bars, lipstick bars, ski wax bars and the like.

U.S. Pat. No. 2,086,462 issued to David E. Bost describes a dispenser for discharging wax or other dispensing material by use of a vertical ratchet mechanism which has a squeeze trigger type handle member and various springs and mechanisms interconnected, including a clamping member and at least three pins or shafts and about six or seven separate pieces for the ratchet advancing mechanism.

U.S. Pat. No. 2,872,034 describes a lipstick container which has a typical twist to advance mechanism.

U.S. Pat. No. 3,221,409 issued to Charles J. Thiel and Louis J. Michaels describes an amalgam dispenser which, again, utilizes a trigger type mechanism with spring, pins and a complex arrangement of components.

U.S. Pat. No. 3,977,574 describes a dispensing pipette actuator system. This system also utilizes a ratcheting mechanism in a vertical direction but requires at least two springs and six or seven components for the ratchet driving mechanism.

U.S. Pat. No. 4,318,499 issued to Joel A. Hamilton, describes a propulsion apparatus with a self contained handle for use with a removable cartridge. This involves movement of hinged, semi-flexible ratcheting members as well as a plurality of springs and pins.

U.S. Pat. No. 4,323,176 describes a manually operable ratchet type dispenser for comestibles which includes a vertical ratcheting mechanism with a handle. This requires at least three pins and four or five complex components.

Thus, notwithstanding the formidable prior art, there seems to be no teaching of the present invention which utilizes a single, semi-flexible component to perform the three functions: a trigger, a ratcheting member to advance a ratchet column and a return spring. Thus, separate from the advancing ratchet column itself, the present invention requires minimal moving parts, no metal springs and no or minimal set pins.

SUMMARY OF THE INVENTION

The present invention involves a dispenser. The dispenser includes a main hollow housing with side walls, a base and an open top which contains a manifold component for dispensing material therethrough. At least one vertical support column is included within the hollow housing and it has horizontal ratchets thereon as well as a push plate located at its top. A trigger component is also contained within the housing and it is formed of plastic material with at least one flexible portion therein. It acts as a trigger, a ratcheting member and a spring, and is strategically positioned in a hinged manner such that a side wall cut-out or other member holding the trigger component against the vertical support column ratchets may be rotated inwardly and released outwardly to cause the ratcheting mechanism to advance the support column. Thus, the trigger component has a first position and a second position wherein, when it is moved from the first position to the second position, it advances the vertical support column upwardly and when it is released and moves from its second position back to its first position, it retreats to the next lower ratchet on the support column and is set for the next advance. In one preferred embodiment, the main hollow housing has two separate components for ease of manufacturing and assembling.

BRIEF DESCRIPTION OF THE DRAWINGS

The present invention will be more fully understood when the disclosure set forth in the specification herein is taken in conjunction with the drawings appended hereto. Those drawings are.

DETAILED DESCRIPTION OF THE PRESENT INVENTION

The present invention is directed to a ratchet dispenser which is superior to the prior art dispensers due to its particular construction and design as well as its unique function. The improvement of the present invention device involve elimination of metal springs, pins and a significant plurality of components for ratcheting, thus substantially decreasing the likelihood of brakeage, simplifying construction and decreasing costs of manufacture. It is used to dispense viscous, force-flowable materials through a manifold dispenser such as gels, and the like.

Figure 1:
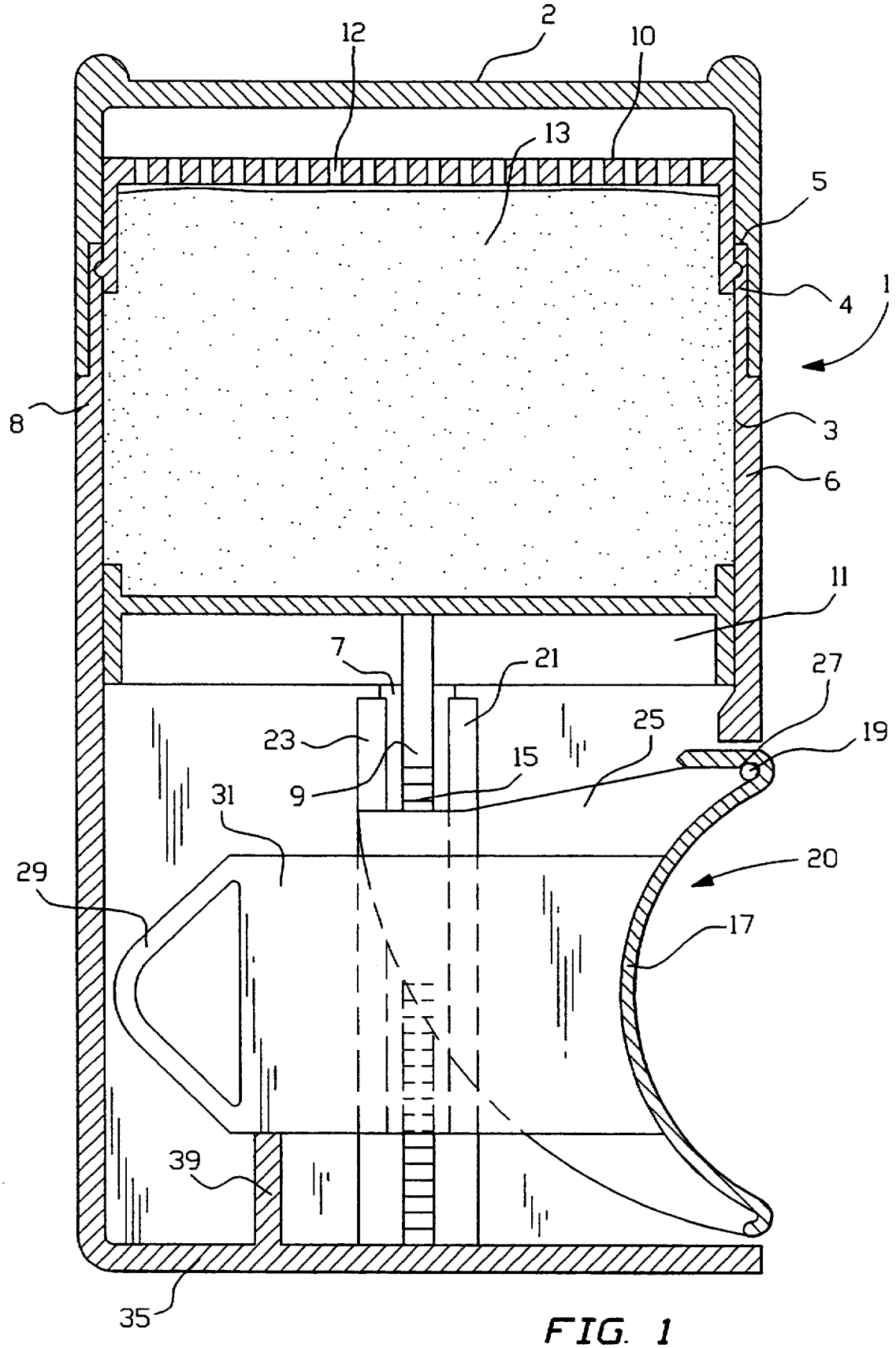
FIG. 1 shows a front cut view of a present invention vertical ratchet dispenser and FIG. 2 shows a rear cut perspective view of the container of the present invention device shown in FIG. 1.

Referring now to FIG. 1 there is shown a front cut view of present invention dispenser 1. Dispenser 1 includes a main hollow housing 3 which has side walls such as side walls 6 and 8 and a base 35. Top 5 is fully open, as it has been developed for dispensing of gel-like materials such as deodorant gel 13. Extended wall portion 4 is adapted to receive lid 2, and to receive and attach manifold component 10, as shown. Manifold component 10 has a plurality of dispensing orifices, as represented by dispensing orifice 12. A vertical support column 7 includes vertical ratchet track 9 with ratchets such as ratchet 15 and is connected to push plate 11. (A corresponding opposite vertical support column would be located under push plate 11 on the portion cut away and therefore not shown). There are guide columns 21 and 23 inside housing 3 in which vertical support column 7 may move upwardly and downwardly, except for its restraint and advance by trigger component 20, discussed below.

Trigger component 20 acts as a trigger, as a ratcheting member and as a spring. It includes trigger lever 17 which is movably connected to main hollow housing 3, i.e. cut out 27 of lever 17 is snapped on or otherwise connected to housing 3 at peg 19 so as to be rotatable or swingable into housing 3. Ratchet advancer fin 25 interacts with ratchet track 9 such that when lever 17 is pushed in, advancer fin 25 swings up and advances and holds track 9 up one ratchet length, thereby advancing push plate 11 and dispenses a redetermined amount of gel-like material 13.

Not only is trigger component 20 functioning as a trigger and a ratcheting advancer, but it also includes spring plate 31 with springy, flexible portion 29. This automatically pushes lever 17 back to its first position (rest position) by springing back from wall 8 so that it and ratchet advancer fin 25 are reset for the next advance. Rest post 39 of base 35 acts as a stop to prevent lever 17 from swinging out beyond its desired rest position.

In preferred embodiments, as shown, the trigger component is unistructurally formed by being molded into one piece but may alternatively be an assemblage of two or more parts. However, there are significant manufacturing advantages achieved when unistructural molding is employed, including ease of manufacture, lower cost, fewer parts, less assemblage, less reject rate, etc.

Figure 2:
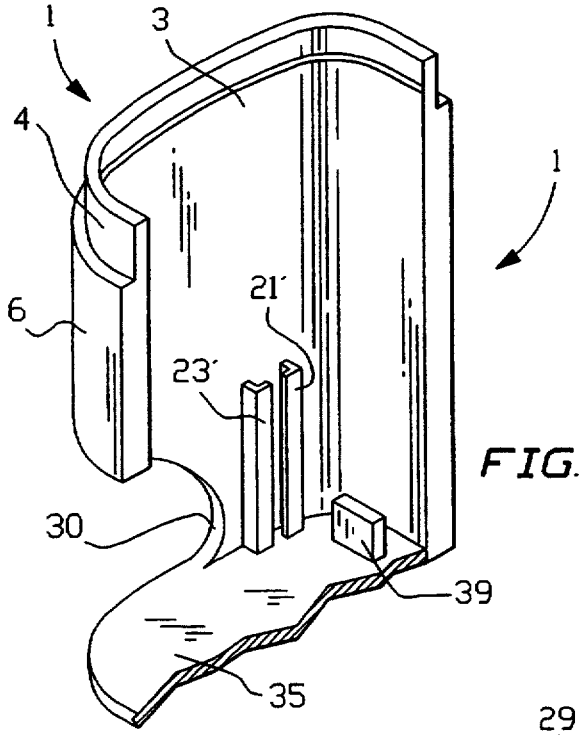

FIG. 2 shows a rear oblique view of a portion of a present invention dispenser 1 housing 3, with identical parts being identically numbered. Here, guide columns 21' and 23' as well as rest 39, are shown in perspective relative to housing 3, and opening 30 is shown for receiving trigger component 20.

Figure 3:
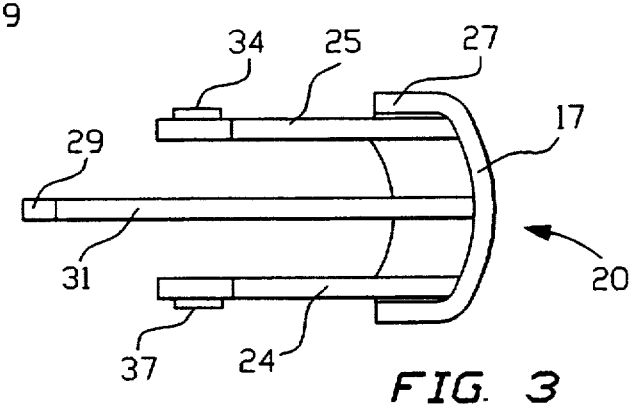
FIG. 3 shows a top view of a present invention device trigger component which utilized in the FIGS. 1 and 2 present invention device.

FIG. 3 shows a top view of trigger component 20. Again, all identical parts are identically numbered. It is clear from FIG. 3 that advancer fin 25 has an opposite counterpart fin 24 and ledges 34 and 37 act to advance a pair of ratchet tracks such as track 9. As an alternative, fins 24 and 25 could extend and include a springfield portion, but in embodiments such as dispenser 1, the curved walls render a center spring portion preferred.

Figure 4:
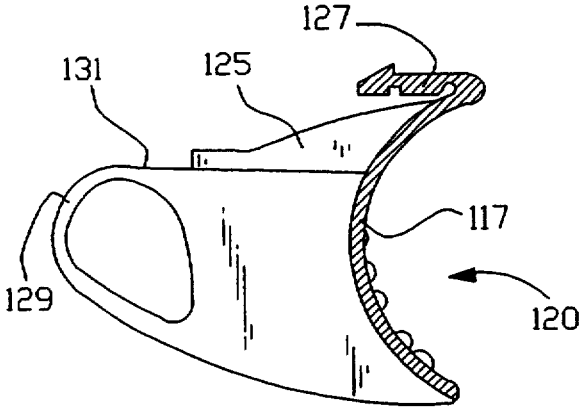
FIGS. 4 and 5 illustrate side view and blown up partial view of an alternative trigger component with ratchet release capability to render a present invention dispenser refillable.
Figure 5:
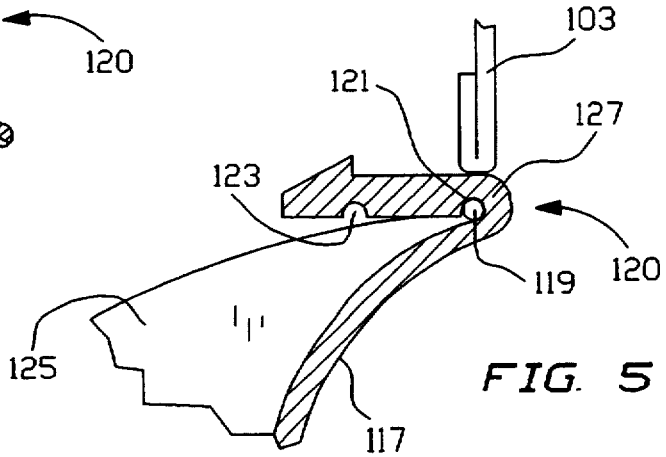

Referring now to FIGS. 4 and 5 together, there is shown a front cut view and a blow-up partial view of an alternative trigger component 120. Included is fin 125, extended portion 131 and spring 129. In this embodiment, lever 117 includes an extension 127 with cut-outs 121 and 123. FIG. 5 shows a portion of a dispenser sidewall 103 and its peg 119 with trigger component 120 connected thereto at cut-out 121 of extension 127. This is the normal, ratcheting-up position. However, in this embodiment, lever 117 may be pulled out so that cut-out 123 slips into peg 119. In this position, ratchet ledges are not in contact with ratchet tracks and thus, a push plate may be pushed down and reset for another full length of ratchet advancement when lever 117 is pressed back into its ratchet-up position, i.e. with cut-out 121 on peg 119. Thus, this may be used in a dispenser such as dispenser 1 of FIG. 1 with refillable capabilities.

Figure 6:
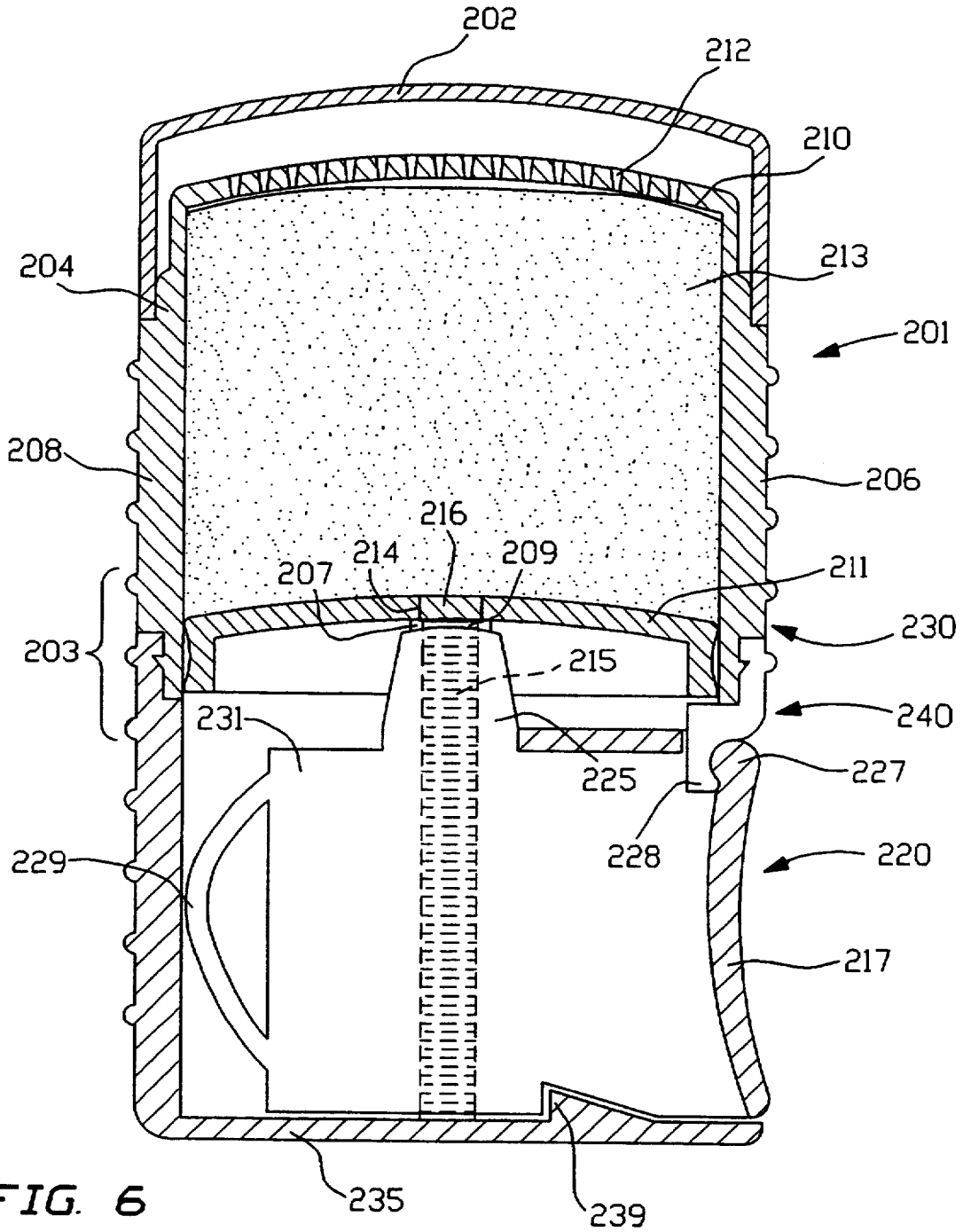
FIG. 6 illustrates an alternative embodiment present invention dispenser in a front, cut view.

Referring now to FIG. 6 there is shown a front cut view of an alternative embodiment present invention dispenser 201. Dispenser 201 includes a main hollow housing 203 which has side walls such as side walls 206 and 208 and a base 235. In this embodiment, housing 203 has two separate sections, an upper section 230, and a lower section 240. Upper section 230 includes a top which is open by virtue of an integrally formed manifold component 210, which includes a plurality of dispensing orifices such as orifice 212 for dispensing of gel-like materials such as deodorant gel 213. Extended wall portion 204 is adapted to receive lid 202.

A vertical support column 207 includes vertical ratchet track 209 with ratchets such as ratchet 215 and is connected to push plate 211. Push plate 211 includes an optional fill hole 214 with fill hole plug 216. There may be guide columns (not shown) such as in FIG. 1 which would be located inside housing 203 in which vertical support column 207 may move upwardly and downwardly, except for its restraint and advance by trigger component 220, discussed below.

Trigger component 220 acts as a trigger, as a ratcheting member and as a spring. It includes trigger lever 217 which is movably connected to main hollow housing 203, i.e. rounded pin 227 of lever 217 is snapped onto extension 228 of lower section 240 of housing 203 or otherwise connected to housing 203 so as to be reciprocally rotatable or swingable into housing 203. Ratchet advancer fin 225 interacts with ratchet track 209 such that when lever 217 is pushed in, advancer fin 225 swings up and advances and holds track 209 up one ratchet length, thereby advancing push plate 211 and dispenses a predetermined amount of gel-like material 213.

Not only is trigger component 220 functioning as a trigger and a ratcheting advancer, but it also includes spring plate 231 with springy, flexible portion 229. This automatically pushes lever 217 back to its first position (rest position) by springing back from wall 208 so that it and ratchet advancer fin 225 are reset for the next advance. Stop 239 of base 235 acts as a stop to prevent lever 217 from swinging out beyond its desired rest position.

Obviously, numerous modifications and variations of the present invention are possible in light of the above teachings. It is therefore understood that within the scope of the appended claims, the invention may be practiced otherwise than as specifically described herein. For example, "gel" and "gel-like material" are used herein. These should be construed to mean any flowable material that is viscous enough not to run out of the manifold on its own and is, hence, force flowable, e.g. petroleum jelly, face creams, shaving gels and deodorant gels.

What is claimed is:

1. A gel-like material dispenser, comprising:

(a) a main hollow housing having a sidewall, a base and an open top for dispensing material therethrough;

(b) a manifold component attached to said open top of said housing;

(c) at least one vertical support column having horizontal ratchets thereon, said at least one support column being vertically slidable mounted within said main hollow housing;

(d) a push plate located at the top of said at least one support column;

(e) a trigger component movably and hingedly connected to said main hollow housing and functionally contactable with the horizontal ratchets of said at least one vertical support column, said trigger component having a flexible spring portion and having an advancer fin, said trigger component being reciprocally movable between a first position and a second position such that when said trigger component is moved from said first position to said second position, it moves said at least one support column upwardly one ratchet length, and when said trigger component is moved from said second position to said first position, it retreats to a next lower horizontal ratchet of said at least one support column; and further, wherein a first portion of said sidewall of said housing has a cut out a peg so as to be connected to a top portion of said trigger component, and wherein said trigger component includes a plural position attachment means for attachment thereof to said housing peg and said plural position attachment means has an active position and a passive position wherein, in said active position, said advancer fin of said trigger component is in functional contact with said ratchets of said at least one vertical support column, and, in said passive position, said advancer fin of said trigger component is not in functional contact with said ratchets of said at least one vertical support column, said flexible spring portion of said trigger component acts as spring biased against a second portion of said sidewall of said housing.

2. The dispenser of claim 1 wherein said housing has two separate components which are connectable to one another, one being an upper section which receives and attaches said manifold component thereto, the other being a lower section which receives and attaches said trigger component thereto.

3. The dispenser of claim 2 wherein said trigger component acts as a spring biased against said lower section of said second portion of said sidewall of said housing.

4. The dispenser of claim 1 wherein said manifold component is an integral part of said housing.

5. The dispenser of claim 1 wherein said manifold component is a separate element from said housing.

6. The dispenser of claim 1 wherein said manifold component comprises a plurality of dispensing orifices.

7. A gel-like material dispenser, comprising:

(a) a main hollow housing having sidewalls, a base and an open top for dispensing material therethrough;

(b) a manifold component attached to said open top of said housing;

(c) at least one vertical support column having horizontal ratchets thereon, said at least one support column being vertically slidable mounted within said main hollow housing;

(d) a push plate located at the top of said least one support column;

(e) a trigger component movably and hingedly connected to said main hollow housing and functionally contactable with the horizontal ratchets of said at least one vertical support column, said trigger component having a flexible spring portion and having an advancer fin, said trigger component being reciprocally movable between a first position and a second position such that when said trigger component is moved from said first position to said second position, it moves said at least one support column upwardly one ratchet length, and when said trigger component is moved from said position to said first position, it retreats to a next lower horizontal ratchet of said at least one support column, wherein said trigger component includes a plural position attachment means for attachment thereof to said housing and said plural position attachment means has an active position and a passive position, wherein, in said active position, said advancer fin of said trigger component is in functional contact with said ratchets of said at least one vertical support column, and, in said passive position, said advancer fin of said trigger component is not in functional contact with said ratchets of said at least one vertical support column.

8. The dispenser of claim 7 wherein at least one of said sidewalls of said housing has a cut out and a peg so as be connected to a top portion of said trigger component.

9. The dispenser of claim 7 wherein said trigger component flexible spring portion acts as a spring biased against one of said sidewalls of said housing.

10. The dispenser of claim 7 wherein said housing has two separate components which are connectable to one another, one being an upper section which are receives and attaches said manifold component thereto, the other being a lower section which receive and attaches said trigger component thereto.

11. A gel-like material dispenser, comprising:

(a) a main hollow housing having sidewalls, a base and an open top for dispensing material therethrough;

(b) a manifold component attached to said open top of said housing;

(c) at least one vertical support column having horizontal ratchets thereon, said at least one support column being vertically slidable mounted within said main hollow housing;

(d) a push plate located at the top of said at least one support column;

(e) a trigger component movably and hingedly connected to said main hollow housing and functionally contactable with the horizontal ratchets of said at least one vertical support column, said trigger component having a flexible spring portion and having an advancer fin, said trigger component being reciprocally movable between a first position and a second position such that when said trigger component is moved from said first position to said second position, it moves said at least one support column upwardly one ratchet length, and when said trigger component is moved from said second position to said first position, it retreats to a next lower horizontal ratchet of said at least one support column;

wherein said trigger component, said advancer fin and said flexible spring portion are unistructurally molded of one single, semi-flexible component; and further comprising a rest post integrally formed from said base of said main hollow housing for preventing said trigger component from swinging in a direction outward from the housing.

12. The dispenser of claim 11 wherein at least one of said sidewalls of said housing has a cut out and a peg so as to be connected to a top portion of said trigger component.

13. The dispenser of claim 12 wherein said trigger component includes a plural position attachment means for attachment thereof to said housing peg ans said plural position attachment means has active position and a passive position wherein, in said active postion, said advancer fin of said trigger component is in functional contact with said ratchets of said at least one vertical support column, and, in said passive position, said advancer fin of said trigger component is not in functional contact with said ratchets of said at least one vertical support column.

14. The dispenser of claim 11 wherein said housing has two separate component which are connectable to one another, one being an upper section which receives and attaches said manifold component thereto, the other being a lower section which receives and attaches said trigger component thereto.

15. The dispenser of claim 14 wherein said trigger component acts as a spring biased against a portion of said lower section of said housing.

16. The dispenser of claim 11 wherein said manifold component comprises a plurality of dispensing orifices.

* * * * *